US010145122B2

(12) United States Patent
Rodriguez Lopez

(10) Patent No.: US 10,145,122 B2
(45) Date of Patent: Dec. 4, 2018

(54) SURFACE COATING AND CLAMP FOR SAID COATING

(71) Applicant: CONTROL Y DESARROLLO EMPRESARIAL, S.L., Cornella de Llobregat (Barcelona) (ES)

(72) Inventor: Julio Rodriguez Lopez, Cornella de Llobregat (ES)

(73) Assignee: Control y Desarrollo Empresarial, S.L., Cornella de Llobregat (Barcelona) (ES)

( * ) Notice: Subject to any disclaimer, the term of this patent is extended or adjusted under 35 U.S.C. 154(b) by 0 days.

(21) Appl. No.: 15/301,544

(22) PCT Filed: Apr. 1, 2015

(86) PCT No.: PCT/ES2015/070264
§ 371 (c)(1),
(2) Date: Oct. 3, 2016

(87) PCT Pub. No.: WO2015/150616
PCT Pub. Date: Oct. 8, 2015

(65) Prior Publication Data

US 2017/0030086 A1 Feb. 2, 2017

(30) Foreign Application Priority Data

Apr. 1, 2014 (ES) ..... 201430475
Apr. 1, 2014 (ES) ..... 201430476

(51) Int. Cl.
*E04F 15/02* (2006.01)
*E04F 13/08* (2006.01)
(Continued)

(52) U.S. Cl.
CPC ..... *E04F 13/0819* (2013.01); *E04B 9/242* (2013.01); *E04B 9/26* (2013.01);
(Continued)

(58) Field of Classification Search
CPC ..... E04F 15/02044; E04F 13/0816; E04F 13/0801; E04F 13/24; E04B 2002/7462;
(Continued)

(56) References Cited

U.S. PATENT DOCUMENTS 1,999,990 A * 4/1935 Carr ..... D01H 7/62 24/293
3,518,800 A * 7/1970 Tank ..... E04F 15/02 52/480

(Continued)

FOREIGN PATENT DOCUMENTS

DE 4115900 A1 10/1992
DE 202007002282 U1 6/2008

(Continued)

OTHER PUBLICATIONS

International Search Report dated Aug. 19, 2015 in PCT/ES2015/070264.

*Primary Examiner* — Gisele D Ford
(74) *Attorney, Agent, or Firm* — Knobbe, Martens, Olson & Bear, LLP

(57) ABSTRACT

Covering comprising a structure formed by a plurality of panels provided on their lower face with at least one guide formed by a groove giving access to a cavity and longitudinal profiles perpendicular to said grooves on the panels, said profiles having, in turn, a guide and clips housed simultaneously in the cavities of both guides of the panel and the profile, the clips having a resilient body that is housed, in the expanded position, in the corresponding cavity, said body comprising at least two legs, each leg having, in turn, a shoulder area intended to make contact with the wall of the cavity immediately adjacent to the groove.

16 Claims, 17 Drawing Sheets

(51) Int. Cl.
*E04B 9/24* (2006.01)
*E04B 9/26* (2006.01)
*E04F 13/076* (2006.01)

(52) U.S. Cl.
CPC ..... *E04F 13/076* (2013.01); *E04F 13/0812* (2013.01); *E04F 13/0816* (2013.01); *E04F 15/02038* (2013.01); *E04F 15/02044* (2013.01); *E04F 2015/0205* (2013.01); *E04F 2015/02055* (2013.01); *E04F 2015/02066* (2013.01); *E04F 2015/02072* (2013.01); *E04F 2201/0138* (2013.01); *E04F 2201/042* (2013.01); *E04F 2201/0505* (2013.01)

(58) Field of Classification Search
CPC ..... E04B 5/023; E04B 9/26; F16B 21/084; F16B 5/0664; F16B 5/0685
See application file for complete search history.

(56) References Cited

U.S. PATENT DOCUMENTS 3,745,736 A * 7/1973 Fischer ..... A63H 33/062 29/453
5,299,402 A 4/1994 Lee
6,199,328 B1 * 3/2001 McGrath ..... E04F 13/0812 52/127.1
7,832,165 B2 * 11/2010 Randjelovic ..... E04F 15/02 52/385
8,186,116 B2 * 5/2012 Anderson ..... E01C 5/001 52/181
2011/0239418 A1 * 10/2011 Huang ..... F16B 5/065 24/592.11
2011/0289875 A1 * 12/2011 Lenoci ..... E04F 15/02 52/302.1
2012/0110944 A1 * 5/2012 Hess ..... E04F 15/02044 52/582.1
2013/0025230 A1 * 1/2013 Turner ..... E04F 15/02044 52/586.1
2013/0255175 A1 * 10/2013 Borowick ..... E04F 15/02183 52/580
2014/0318065 A1 * 10/2014 Torres-Pinzon ..... E04F 15/02044 52/403.1

FOREIGN PATENT DOCUMENTS

ES 1029601 U 5/1995
FR 2814184 A1 3/2002

* cited by examiner

SURFACE COATING AND CLAMP FOR SAID COATING

CROSS-REFERENCE TO RELATED APPLICATIONS

This application is the U.S. National Phase under 35 U.S.C. § 371 of International Application PCT/ES2015/070264, filed Apr. 1, 2015, which claims priority to Spanish Patent Applications P201430476, filed Apr. 1, 2014 and P201430475, filed Apr. 1, 2014.

FIELD OF THE INVENTION

The present invention relates to a covering for surfaces, whether they are vertical (walls) or horizontal (ceilings and floors).

More particularly, the present invention relates to a covering that is easy to remove.

BACKGROUND OF THE INVENTION

A problem with coverings, in particular those of which main function is aesthetic, lies in its removal, for example to access service ducts or to carry out maintenance/repair tasks on the covering itself. What generally happens is that the removal operation makes at least part of the covering useless, or else tensions are generated with the passage of time that deform the components of the covering such that it proves impossible even to remove and reinstall them.

Spanish Utility Model document ES1029601U discloses a parquet flooring for moveable mounting that can be completely dismantled and is constituted by a plurality of parquet boards provided on their side edges with tongue-and-groove components. On their lower face, the boards have a longitudinal groove with a T section, which serves as a guide for a plurality of clips which, when positioned in their seats within the guide provided on each board, are coupled over some profiles with a generally U-shaped section, the upper ends being bent inwards. The clips in said document are flat clips with a horizontal head and two bent arms. Each arm has a 90° bend, the function of which is to press against the vertical wall of the profile into which they are inserted. Said clips are implemented in metallic material. The clips do not impede the movement of the boards in the horizontal direction, along the axes defined by the profiles and the grooves of the boards.

A problem associated with this flooring is that it is not suitable for ceilings and walls. Indeed, the clip does not exert sufficient retention force, especially in the vertical direction, which means that the slats give way spontaneously. Another problem is that the clips show plastic deformations, so that all have to be replaced after dismantling.

A further problem with this flooring is that it is not suitable for being located outdoors since, while although it allows movements of the boards owing to thermal expansion or absorption of moisture, it has no water drainage channels.

Yet another problem, associated with being located indoors, is that its use as a covering leaves no routes for the passage of air between the boards, which could be useful for premises that have to be ventilated, or for premises that must be heated. So, that flooring does not allow heating elements to be installed below the covering.

The document DE 4115900 A1 discloses a covering for ceilings or walls that comprises embedded guides that are covered by panels with guides perpendicular to the embedded guides. The embedded guides and the panels are joined by means of clips having a flat, smooth head which can slide through the guides of the panels and has two legs that are introduced into the embedded guides. The legs each end in feet intended to make contact with the wall of the cavity of the embedded guide immediately adjacent to the groove in the embedded guide. The feet thereby prevent the panels from falling as a result of gravity. However, the legs do not make contact with the wall opposite said wall adjacent to the groove, and therefore the covering is not suitable for floors and, furthermore, any dimensional defect of the clip means that the whole weight of the panel is concentrated on one point of the clip and the panels frequently fall down.

There are known coverings which are suitable for outdoors and in which a separation or channel is left between the boards. Said separation is produced by positioning clips between adjacent boards. The clip stays fixed to the supporting structure and also to each of the boards. The edges of the boards can have both a flat finish and a tongue-and-groove finish, as can be seen in documents ES1041505U and ES2393678T3. However, positioning the clips fixes the boards so that they are then not able to absorb any movement. Furthermore, it is now not easy to remove the boards: the clip becomes indented into the boards and damages them.

SUMMARY OF THE INVENTION

One object of the present invention is to disclose a covering that can be dismantled, of the type allowing mobility in horizontal displacement, and that is suitable for all kinds of surfaces, both floors as well as walls and ceilings.

Another object of the present invention is to disclose a covering that allows its panels to move and, at the same time, permits a separation between the panels that allows water and air to pass through them.

The invention is defined by the attached claims.

In particular, the present invention discloses a covering comprising a structure formed by a plurality of panels provided on their lower face with at least one guide formed by a groove giving access to a cavity with larger dimensions, in cross section, than the opening corresponding to the groove, and longitudinal profiles perpendicular to said grooves on the panels, said profiles having, in turn, a guide for the profile formed by a groove giving access to a cavity with larger dimensions, in cross section, than the groove, there being, in the areas of intersection between the guides of the panels and the guides of the profiles, clips housed simultaneously in the cavities in both guides of the panel and the profile, characterised in that the clips have a thickened head intended to be introduced into one of the cavities, and a resilient body, the resilience of which causes it to adopt a first compressed position in which it can pass transversely through the groove corresponding to the guide in which the head is not housed, and which, in the expanded position, is housed in the cavity corresponding to the guide in which the head is not housed, in that said body comprises at least two legs, each leg having, in turn, a preferably flat shoulder area intended to make contact with the wall of the cavity immediately adjacent to the groove.

Unlike the prior art, the clip does not use transverse expansion after passing through the groove to fasten the clip, but rather provides a shoulder structure acting as a stop to prevent the clip from being removed, the force opposing removal is passive and in a direction parallel to the extraction movement, which is more efficient than the resilient force, practically perpendicular to the extraction movement, which was produced in coverings known heretofore.

Preferably, in turn, one or each of the legs also makes contact with the wall opposite said walls adjacent to the cavity, such that the clip, preferably its legs, are compressed resiliently within the cavity, in a second compressed position distinct from said first compressed position. This increases the resistance to be overcome in order to remove the clip. Removal by an eccentric force, i.e. a force combining an extraction torque, is also hindered.

Preferably, each of the legs is formed by a shoulder area that continues into an appendage, the free end of which points towards the central axis of the clip. This feature proves particularly advantageous because it causes the clip to expand outside its normal position within the cavity, preventing its accidental removal even further.

More preferably, the free appendage is curved. Also preferably, the head of the clip is a flat area that has protrusions in its free area in order to make contact with the wall opposite the groove in the cavity into which it is introduced.

Preferably, the clip will be made of synthetic material, more preferably of thermoplastic material. Other materials may also be suitable for the present application, or other materials with which its function may be optimised, such as graphene.

The present invention also comprises a clip for the type of covering of the present invention, which is characterised in that it has a thickened head and a resilient body, the resilience of which causes it to have a first compressed position characterised in that said body comprises at least two legs, each leg having, in turn, a shoulder area which is preferably flat and substantially perpendicular to the legs.

Preferably, the shoulder area continues into an appendage, the free end of which points towards the central axis of the clip.

More preferably, the free appendage is curved.

The present invention also discloses a type of clip that allows for improved fastening of the panels of the covering of the present invention, making it possible to use the covering as a ceiling and wall covering with larger panels.

The clips preferably have a thickened head intended to be introduced into one of the cavities, and a resilient body, the resilience of which allows it to pass transversely through the groove. Preferably, the resilience of the resilient body causes it to adopt a first compressed position in which it can pass transversely through the groove corresponding to the guide in which the head is not housed, and which, in the expanded position, is housed in the cavity corresponding to the guide in which the head is not housed.

Preferably, said body of the clip comprises at least two legs, each leg having, in turn, a preferably flat shoulder area intended to make contact with the wall of the cavity immediately adjacent to the groove.

Unlike the prior art, the clip does not use transverse expansion after passing through the groove to fasten the clip, but rather provides a shoulder structure acting as a stop to prevent the clip from being removed, the force opposing removal is passive and in a direction parallel to the extraction movement, which is more efficient than the resilient force, practically perpendicular to the extraction movement, as was the case in the coverings known heretofore.

Preferably, in turn, each of the legs also makes contact with the wall opposite said walls adjacent to the cavity, such that the clips are compressed resiliently within the cavity, in a second compressed position distinct from said first compressed position. This increases the resistance to be overcome in order to remove the clip. Removal by an eccentric force, i.e. a force combining an extraction torque, is also hindered.

Preferably, each of the legs is formed by a shoulder area that continues into an appendage, the free end of which points towards the central axis of the clip. This feature proves particularly advantageous because it causes the clip to expand further from its normal position within the cavity, additionally preventing its accidental removal.

More preferably, the free appendage is curved. Also preferably, the head of the clip is a planar area that has separating protrusions in its free area in order to make contact with the wall opposite the groove in the cavity into which it is introduced.

Preferably, the clip will be made of synthetic material, more preferably of thermoplastic material. Other materials may also be suitable for the present application, or other materials with which its function may be optimised, such as graphene.

Even more preferably, the head of the clip is a flat area that has protrusions in its free area in order to make contact with the wall opposite the groove in the cavity into which it is introduced.

In particular, the present invention also discloses a covering comprising a structure formed by a plurality of panels provided on their lower face with at least one guide formed by a groove giving access to a cavity with larger dimensions, in cross section, than the opening corresponding to the groove, and longitudinal profiles perpendicular to said grooves on the panels, said profiles having, in turn, a guide for the profile formed by a groove giving access to a cavity with larger dimensions, in cross section, than the groove, there being, in the areas of intersection between the guides of the panels and the guides of the profiles, clips housed simultaneously in the cavities in both guides of the panel and the profile, and that it is characterised in that the panels have, on at least one of the edges, at least one separating protrusion that does not run along the whole of the edge and that separates said panel from the adjacent panel.

The separating protrusion which does not run along the whole edge allows the panels to be separated from one another without preventing the panel from moving along the axes of the guides, or fluids (air, water) from passing along the separation between the panels.

Preferably, said separating protrusion or protrusions are located on an edge parallel to the guides of the panel.

Preferably, said separating protrusion or protrusions are located on a single edge of the panel.

More preferably, the panel has more than one separating protrusion on the edge or edges on which it has protrusions.

Even more preferably, the separating protrusion will have a prismatic form. It can also consist in a cylindrical form, for example a cylinder, that is introduced into a recess formed on one edge of the panel.

Preferably, the edges of the panels that have separating protrusions will have recesses and protrusions that fit together with the corresponding, or opposite, edge of the adjacent panel, such that the separating protrusion or protrusions are not visible from the outside. A preferable way of producing this effect is achieved when the edge has, on the edge on which said separating protrusion or protrusions are located, a lower recess that runs along the whole length of the edge, the separating protrusion having a length such that it does not project from the upper portion of the edge that does not have said recess.

In accordance with another aspect, the present invention also refers to a covering comprising a structure formed by a plurality of panels and profiles, in which the profiles are positioned in a direction transverse to the panels, in which there is a connection formed between each of said panels and one or more of said profiles, it being characteristic that said connection is such that the panels are slidable in said transverse direction along one or more of said profiles. Preferably, the panels can slide in said transverse direction, either by hand or with a force of less than 500 N per profile connected to the panel, preferably less than 200 N per profile. Obviously, the ease with which the panels can be moved while they are connected to the profiles results in a major advantage when it comes to accessing the space under the covering. One or more panels or one or more rows of panels can be removed at a convenient position and the remaining panels can be slid towards the free space created in order to give access to the desired location under the panels.

It is clear that the covering of the second aspect preferably has the characteristics of the covering of claim 1 or its preferable embodiments, although this is not necessarily the case.

Preferably, said connection is formed by separate clips, each joining a panel and a profile. Said separate clips can be introduced into a groove at the bottom of said panel, wherein said groove runs in the longitudinal direction of said panel. In accordance with a variant, said clips are made in one piece of the same material as the panels or are connected to the panel in a fixed manner, for example by means of screws, nails, glue or other connection means.

Preferably, said separate clips are introduced into a cavity in said profile. Preferably, said separate clips allow for introduction into said cavity by means of a substantially downward movement of said clips towards said profile, regardless of whether or not they are joined to said panels. Preferably, said cavity has a wall adjacent to an opening in said profile, said wall having a step, and in that said clips have hooks that cooperate with said wall when they are introduced into said cavity.

Preferably, said connection is such that the panels can slide in the longitudinal direction of the panels.

BRIEF DESCRIPTION OF THE DRAWINGS

For better understanding, drawings of an embodiment of the surface covering of the present invention are attached by way of explanatory but not restrictive example.

DETAILED DESCRIPTION OF THE PREFERRED EMBODIMENTS

Figure 1:
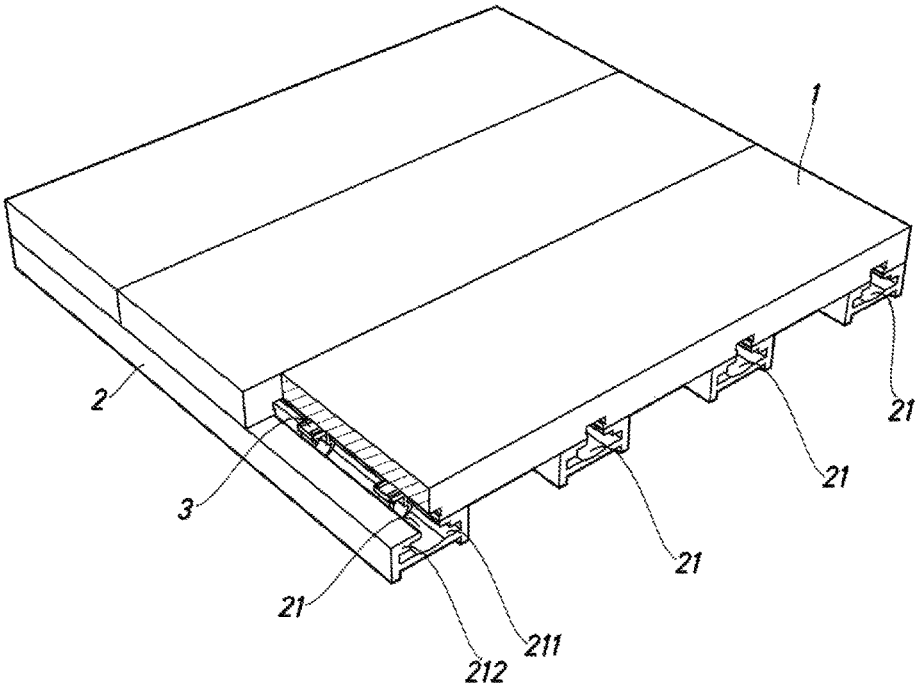
FIG. 1 is a perspective view of a covering according to the present invention, with a partial section of a panel showing the fixing.
Figure 2:
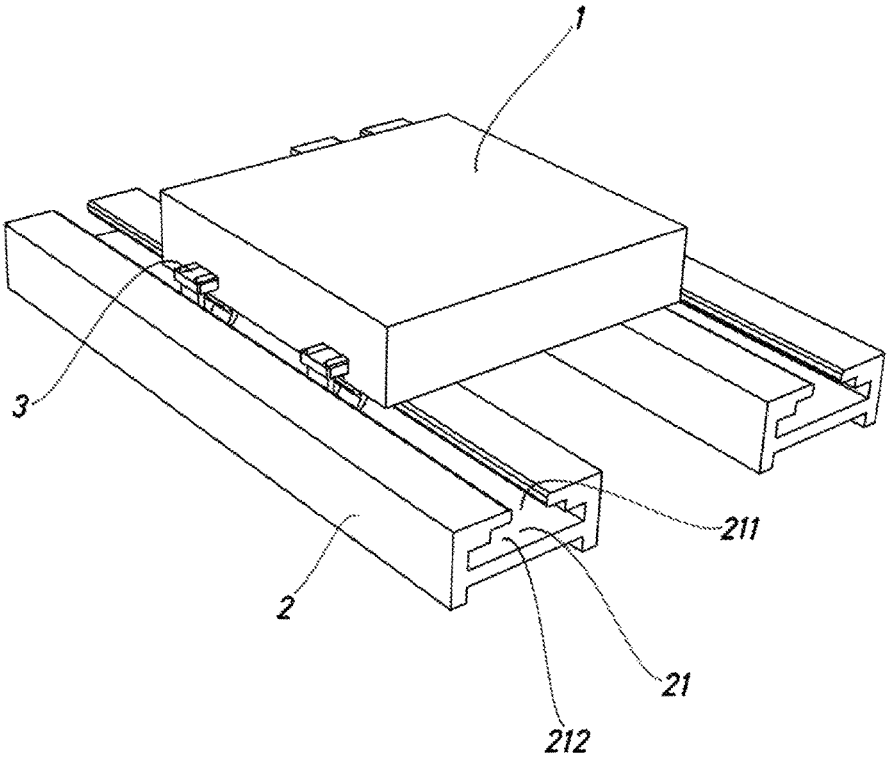
FIG. 2 is a detailed diagrammatic view showing, in partial section, a panel on top of two profiles.
Figure 3:
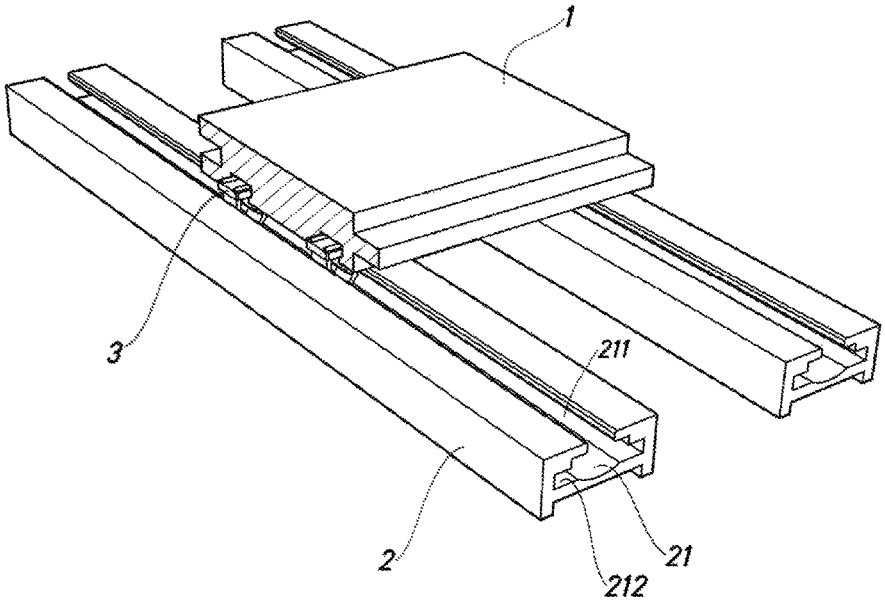
FIG. 3 shows a variant of FIG. 2 in which the panel has an edge with a different shape.
Figure 4:
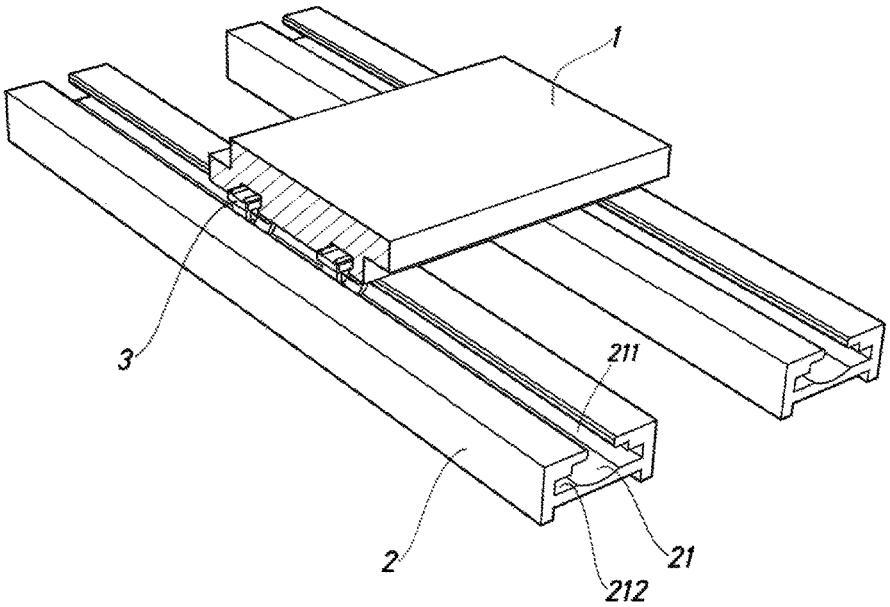
FIG. 4 shows another variant of FIG. 2.

FIG. 1 shows a covering composed of a plurality of panels -1- that rest on elongated profiles -2-, which can be joined by means of clips -3-.

The clips are located simultaneously on guides -11- located on the unseen face of the panels -1-, and inside guides -21- of the profiles -2-.

Figure 5:
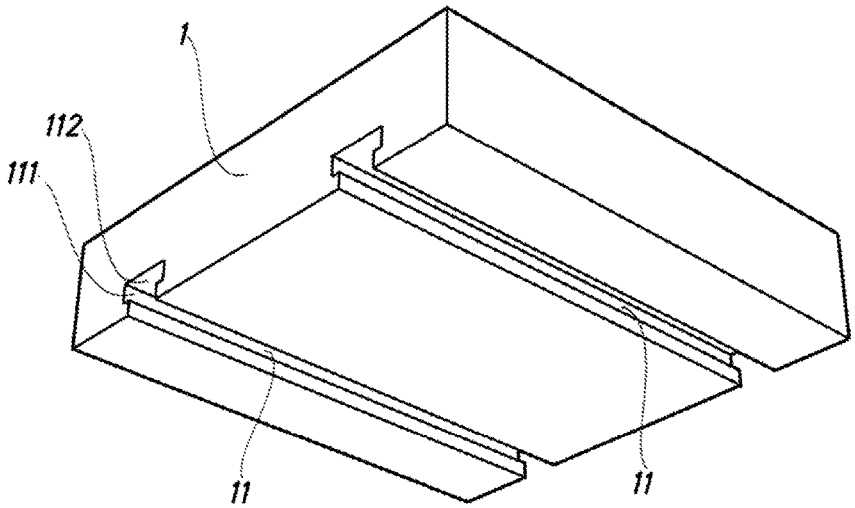
FIG. 5 is a perspective view seen from below, showing the guides of the panel.

In the examples in FIGS. 1 to 7, the panels -1- have edges in contact with each other. The shape of the edges can vary. For example, the edges can be flat. Similarly, each panel has two guides -11-, each positioned on a side running longitudinally along the panel. The edges of the panels -1- could also have protrusions and recesses that fit together, forming a tongue and groove. Where there are protrusions and recesses that fit together, each panel can have a single guide -11-. Naturally, large panels can have a larger number of guides. As shown in FIG. 5, the guides -11- are formed by a cavity -112- that is accessed via a groove -111- with smaller dimensions than those of the cavity. In the example shown, the cavity -112- in the panel -1- is rectangular, so that the guides -11- have a generally T-shaped cross section.

The guides -21- of the profiles -2- run longitudinally along the profiles -2-, being positioned perpendicularly to the guides -11- of the panels -1-. Similarly, the guides -21- are formed by a cavity -212- which, in cross section, has larger dimensions than the groove -211- via which it is accessed.

At the crossing or intersection points between the guides -11- of the panels -1- and the guides -21- of the profiles -2- there are clips introduced into the cavities -112-, -212- corresponding to the guides -11-, -21- which cross over each other, fastening the panels -1- to the structure that they hide. This arrangement has the advantage that the covering is fastened to the structure, but without fixed, immovable points, so the panels permit movements in the directions defined by the guides -11-, -21-. Said movements can be produced by expansion or contraction of the panels because of heat or cold, or to temperature differences between the various parts of the covering. Or else because of changes in ambient humidity, in the case of materials that absorb moisture, such as plastics together with wood or derivatives, or types of wood.

Figure 6:
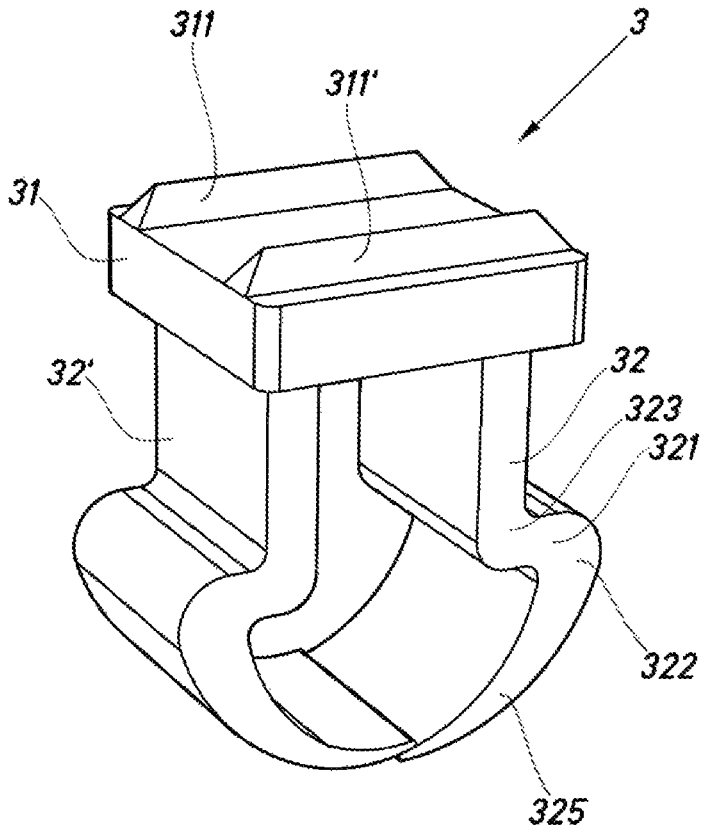
FIG. 6 is a perspective view of a clip according to the present invention.

As can be seen in FIG. 6, the example shown of a clip -3- of the present invention is formed by a flat, square head -31-, from which two protrusions project, in the form of ribs -311-, -311'-, the function of which is to ensure contact with the wall of the cavity -112- in the guide -11- of the panel -1- opposite the groove -111- giving access to said cavity. The aim of making contact is that of collaborating in compressing the resilient components of the clip along an axis that is simultaneously perpendicular to the longitudinal axes of the guides -11- of the panels -1- and the guides -21- of the profiles -2-, which are in turn perpendicular to each other. However, doing this by means of ribs has the advantage of not unduly increasing the friction between the clip -3- and the panel -1-, which is desirable both for the installation operations and for any movements to be absorbed subsequently by the covering, once installed.

The heads of the clips can be rectangular, one of their sides being smaller in dimensions than the groove -111- giving access to the cavity -112- in the guides of the panels, and this allows them to be introduced at any point on the guides -11- which, as has already been mentioned, run along the whole panel -1-.

Once in position, the clip can be rotated on itself so as to cause it to be fixed by dimensional interference with the guide -11-, taking advantage, for this purpose, of the fact that the head -31- of the clip -3- has a rectangular shape, i.e. the head -31- of the guide has one side with smaller dimensions than the corresponding width of the guide -11- and another side with equal or slightly greater dimensions, such that the clip can be rotated in the guide -11- and adjusted by tightening.

Once positioned and fixed in position, the clips can be introduced by means of a vertical movement into the guides -21- of the profiles.

On making said movement the parts of the clips are initially deformed and then expand again inside, producing internally an expansion force that prevents the vertical movement of the panel, for example, due to footsteps, etc., but at the same time allows the panels to move along the grooves in the guides. The clips, in turn, allow the panels to be removed when a sufficiently great extraction force is made in the vertical direction. Other methods of introducing the clips are also possible.

Two legs -32-, -32'- emerge from the head -31- of the clip -3-, said legs being flat and parallel to each other in the example shown, and forming the resilient portion of the clip -3-. Each leg -32-, -32'- has an initial straight part followed by a shoulder area -321- defined between two curves -323-, -322-, and finally an appendage -325- finishing in a free end. The appendage -325- of the example has a curved shape and its free end points towards the centre of the clip. The ends of the two legs -32-, -32'- can have their free ends facing each other, but leaving a small separation space. In the example shown a free end of one of the legs -32- of said free ends facing each other is situated above or below the free end of the opposite leg -32'-.

The clip -3- is made of flexible material, preferably a thermoplastic, which permits the elastic deformation of the legs -32-, -32'-. Other materials are also possible.

The legs -32-, -32'- in the vicinity of the head -31- are situated at a distance from each other such that they can penetrate the grooves in the guides into which they are inserted, preferably without the need for deformation.

Figure 7:
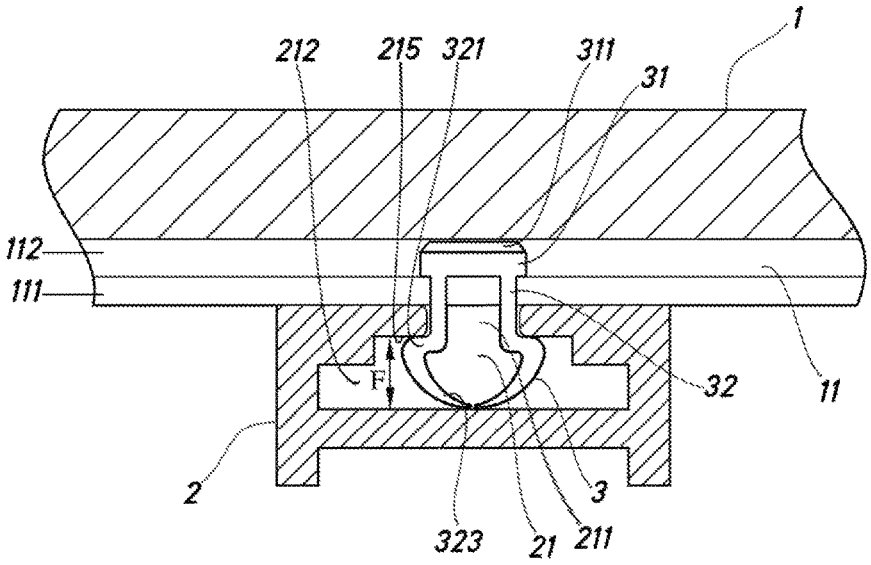
FIG. 7 is a view in cross section showing the positioning and functioning of a clip, located simultaneously in the guide of a panel and in the guide of a profile transverse thereto.

In the example shown in FIG. 7, in order to be installed in the guide -21- of a profile, the clip -3- must be deformed elastically, a force being exerted on the shoulder area -321- to bring together the curved extensions -323-, -322- of each of the legs -32-, 32-'-. The legs can thereby penetrate the groove -211-. Once in the cavity -212-, the legs -32-, -32'- can expand freely in the direction perpendicular to the introduction direction and the shoulder -321- recovers its original position. Simultaneously, the free ends of the legs come into contact with the wall of the cavity -212- opposite the groove -211-, being deformed and transmitting a force in both directions marked with the double arrow -F-, which keeps the shoulders -321- in contact, between each other, with the wall -215- immediately adjacent to the groove -211-. In this position, therefore, the clip -3- has a second deformed state, different from the deformed state induced during introduction. Likewise, the clip -3- is secured by dimensional interference between the shoulders and the walls of the guide in a plane perpendicular to the direction of introduction of the clip. In an ancillary manner, in the example shown, the clip has a shape such that it exerts, by deformation within the cavity, a force perpendicular to the contact surface of the shoulders with the walls of the cavity, which secures the position of the clip even more. However, movements of the panels -1- in the directions defined by the guides of the profiles -3- and the guides of the panels -2- are permitted.

Figure 8:
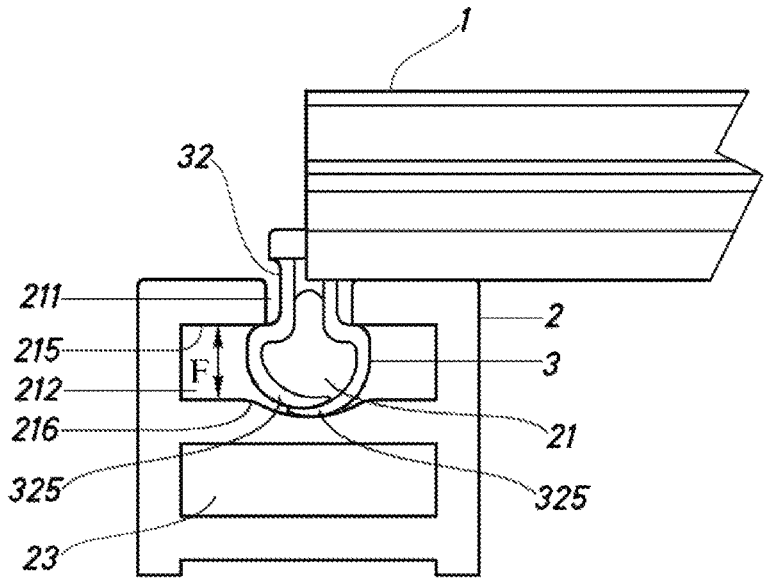
FIG. 8 is a view in cross section similar to that in FIG. 7 in which another type of profile has been used.

FIG. 8 corresponds to FIG. 7 in which a different profile -2- has been used.

In FIG. 8 the components that are the same as or similar to those in FIG. 7 have been labelled with the same numerals as in said figure and will not, therefore, be described in detail.

As can be seen, FIG. 8 shows the use of a different profile -2-. In this case, it can be seen that the cavity -212- has a recess -216- in the wall of the cavity opposite the groove -211-. This cavity can accommodate the appendages -325- of the legs of the clip -3-. This is favourable to the correct operation of the assembly.

The profile can vary from that shown in the figures, and can be a profile that can be used for different types of clips.

The figure also shows how in this case just one of the legs makes contact with the wall opposite said walls adjacent to the groove. As is the case in FIG. 7, this means that the clip can be compressed in a second compressed position.

Figure 9:
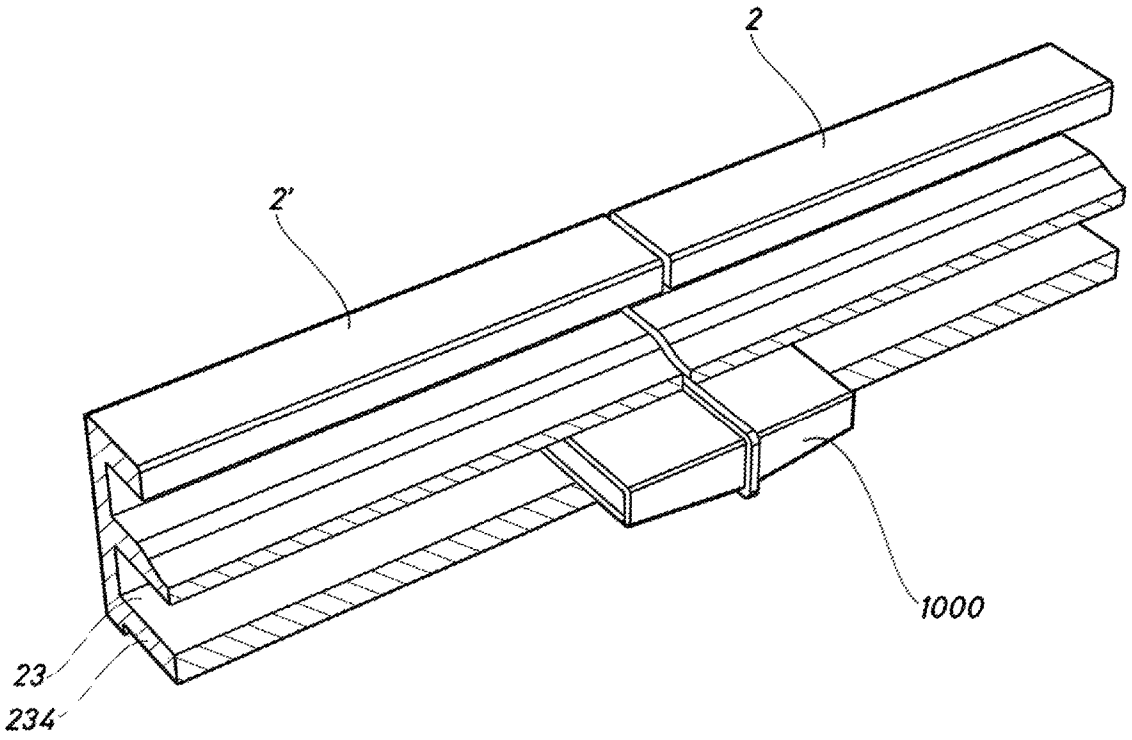
FIG. 9 is a perspective view in partial cross section, showing a method of joining consecutive profiles as shown in FIG. 8.
Figure 10:
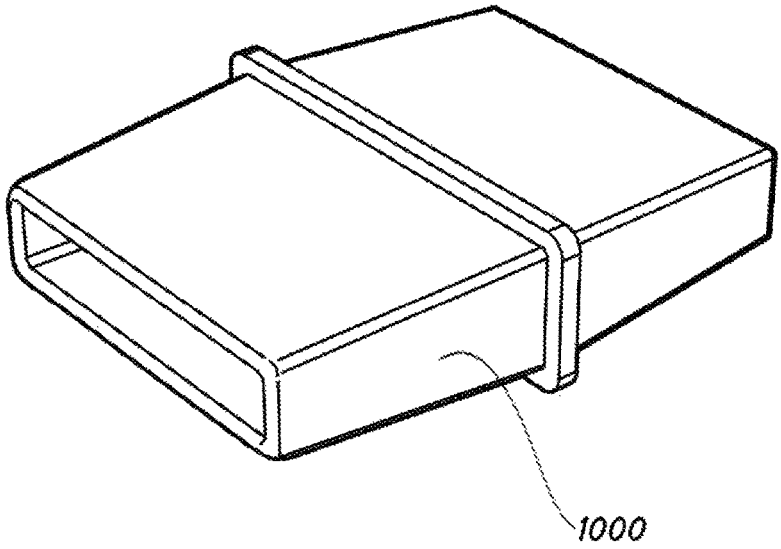
FIG. 10 shows the part for joining profiles in FIG. 9.
Figure 11:
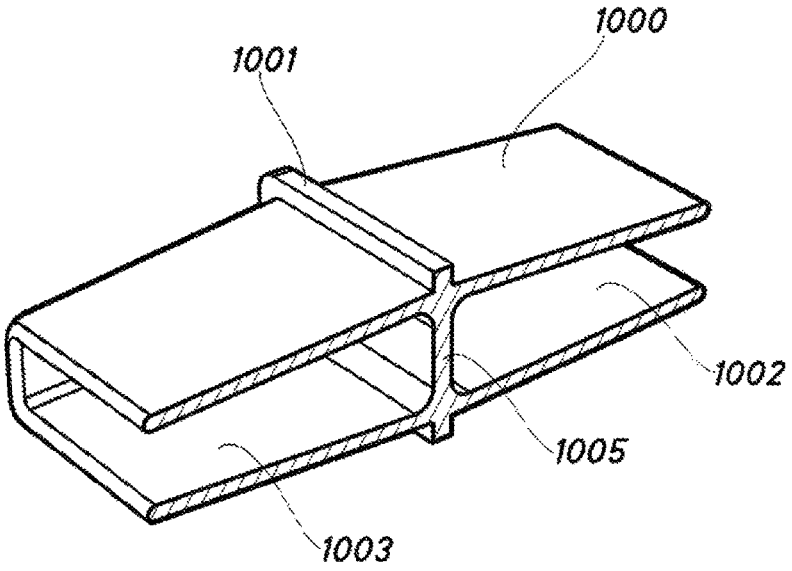
FIG. 11 is a cross section of the part in FIG. 10.
Figure 12:
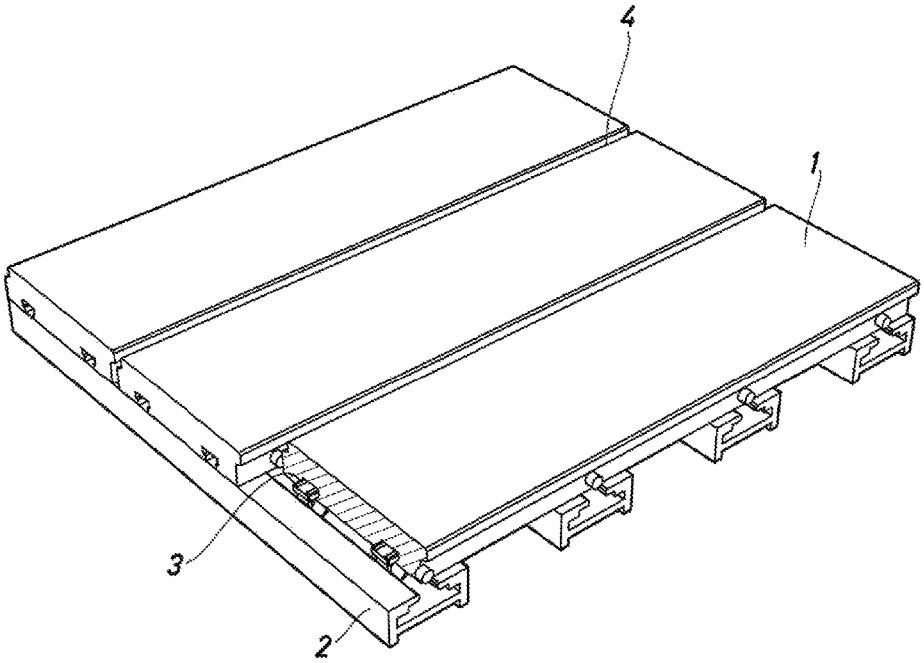
FIG. 12 is a perspective view of a second embodiment of a covering according to the present invention, with a partial section of a panel showing the fixing.
Figure 13:
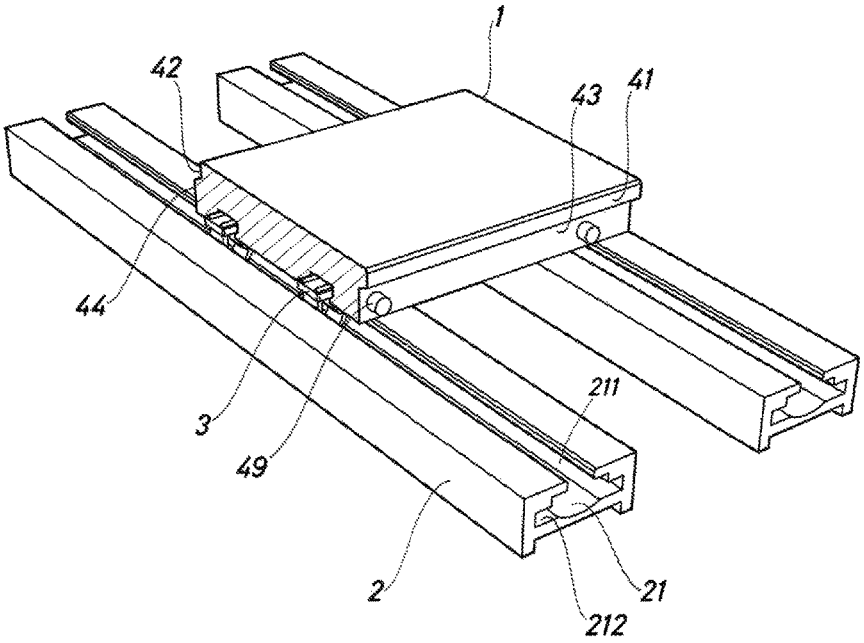
FIG. 13 is a detailed diagrammatic view of the second example showing a panel in partial section on top of two profiles.
Figure 14:
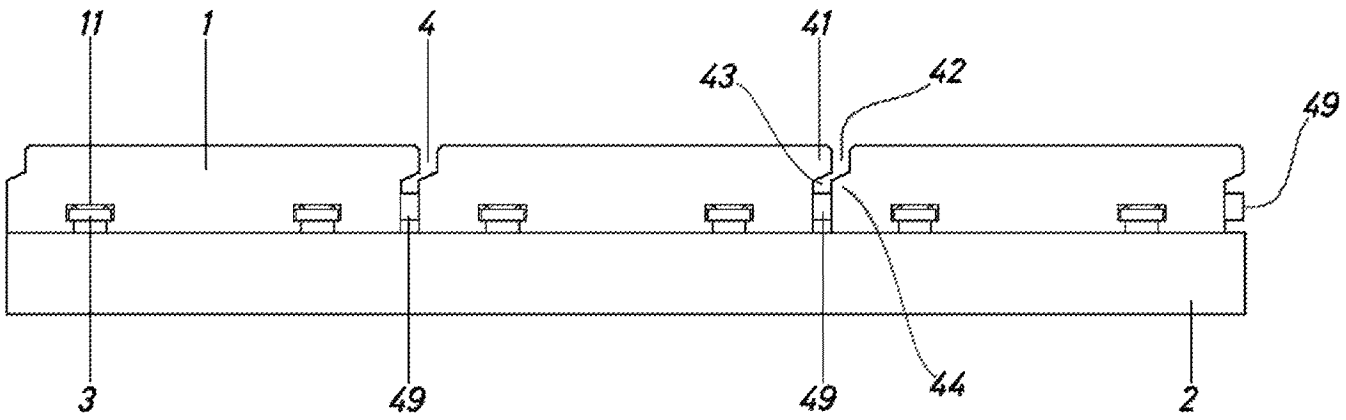
FIG. 14 is a side elevation view of the covering of the example in FIG. 12.
Figure 15:
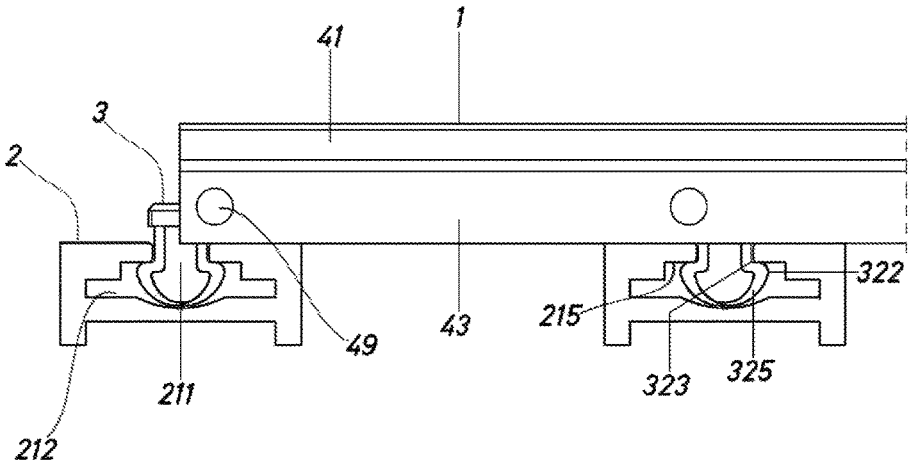
FIG. 15 corresponds to a front elevation view of the detail in FIG. 13.

FIGS. 9 to 11 show a possible embodiment of a joint between consecutive profiles -2-, -2'- by means of parts -1000- having two cavities -1002, -1003- accessible from either end and separated by a partition -1005-.

As can be seen, the parts -1000- are introduced into the intermediate void -23-.

The part -1000- also has, in its middle area, a peripheral flange -1001- acting as a stop with the profiles -2-, -2'-, favouring the correct positioning of the joint.

FIGS. 12 to 17 show a covering composed of a plurality of panels -1- that rest on elongated profiles -2-, which can be joined by means of clips -3-.

In FIGS. 12 to 17 the components that are the same as or similar to those in FIGS. 1 to 11 have been labelled with the same numerals.

The clips are located simultaneously on guides -11- located on the unseen face of the panels -1-, and inside guides -21- for the profiles -2-.

Each panel -1- has two guides -11-, each positioned on one side running longitudinally along the panel. The edges of the panels -1- that are parallel to the guides -11- have protrusions -41-, -44- and recesses -43-, -42- that fit together with the edge of the adjacent panel, which they face. These recesses and protrusions run longitudinally along the whole edge. The set of recesses and protrusions in the case shown corresponds to a tongue-and-groove arrangement, although in this case the tongue-and-groove arrangement is not actually formed, since there is a distance between the panels. Other configurations of recesses and protrusions, different from tongue and groove, are also possible. In this case it is especially preferable for the panel to have at least two parallel guides -11- arranged symmetrically. This ensures that the fastening is equally strong on both edges parallel to the guides -11-. This can be important in some cases owing to the fact that the edge are neither fixed nor have their movements limited by being fully in contact with the surface of the edge of the adjacent panel. Naturally, large panels can have a larger number of guides.

The separating protrusions -49- are located in the lower recesses -43- of the panels. These separating protrusions are intermittent and do not run along the whole edge. In this case the separating protrusion is a cylindrical part that is introduced into a special housing located in the lower recess -43-. The separating protrusion -49- has a length equal to or, preferably, slightly less than the depth of the recess -43-. In this way the separating protrusion -49- does not project out from the perimeter of the panel and, in particular, does not project beyond the upper protrusion -41- corresponding to the portion of the edge that does not have the recess -43-. This means that the separating protrusion cannot be seen from outside the covering. The corresponding edge of the adjacent panel has a matching recess -42- and a matching protrusion -44- that fit together with the protrusion -41- and the recess -43- of the adjacent panel. In particular, the recesses and protrusions -41-, -43- of one panel correspond to the reverse of the recesses and protrusions -44-, -42- of the other panel. In this way the edges of the panels do not touch, and air or water can pass through. If the separating protrusions -49- were to run along the whole edge this effect would not be possible. Naturally, other configurations are possible. Taking FIG. 14 as a starting point, for example, a separating protrusion could be made rather shorter, at the expense of the protrusion -44- (and/or the recess -42-) being rather more marked.

Figure 16:
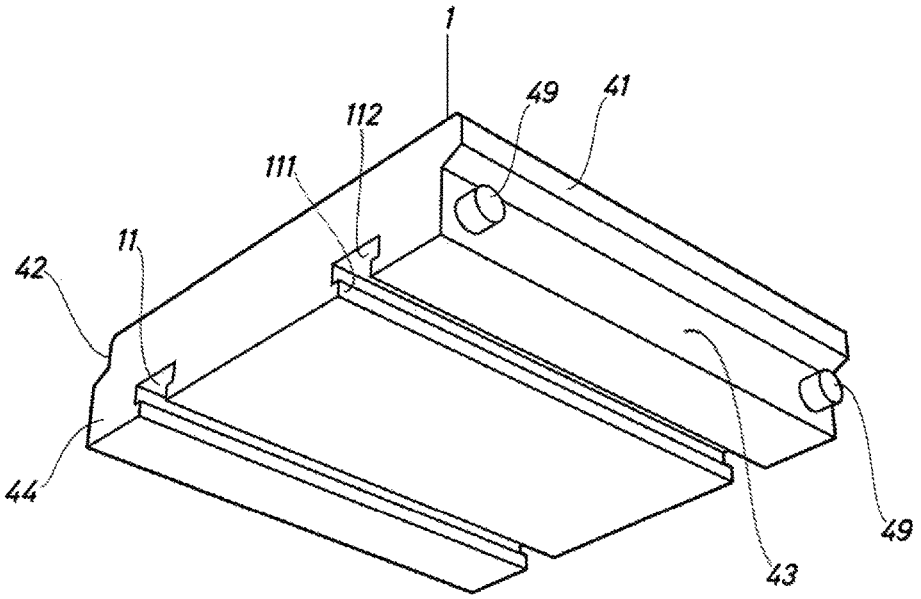
FIG. 16 is a perspective view of the second example seen from below, showing the guides of the panel.

As shown in FIG. 16, the guides -11- and -21- have a similar structure to the guides -11- and -21- of the example shown in FIGS. 1 to 7.

Figure 17:
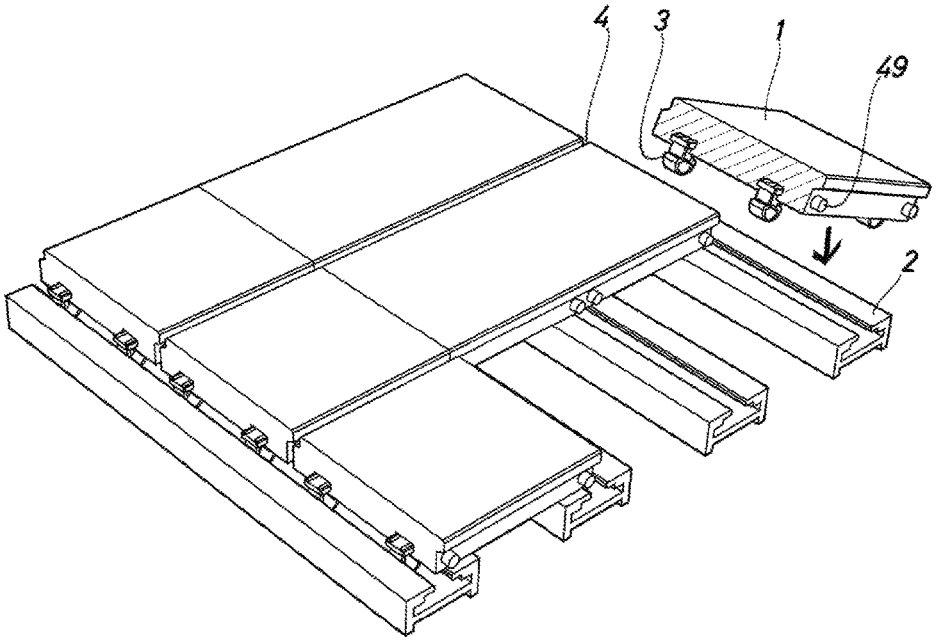
FIG. 17 is a perspective view showing diagrammatically a method of positioning a panel of the covering in FIG. 12.

As can be seen in FIG. 17, the clip -3- shown is also similar to that of the examples in FIGS. 1 to 11, and will therefore not be explained in detail.

The clips -3- can be located in the guides of the panels and then the panel can be installed by press-fitting the clips into the guides of the profiles, deforming the legs of the clips by means of the vertical movement shown in FIG. 17.

Other introduction methods are also possible.

The embodiments shown in the figures also constitute an illustration of the second aspect of the present invention disclosed in the introduction.

The present invention is applicable to both horizontal surfaces (ceilings, walls) and vertical ones (walls).

The present invention is suitable for panels made of all kinds of materials.

Although in the embodiment shown the heads of the clips are located in the guides of the panels, which is preferable in certain applications, an inverse embodiment with the heads of the clips introduced into the guides of the profiles would also be possible. For this, the panels will have to have a greater thickness so that there is space to receive the legs of the clips.

The person skilled in the art will notice the numerous advantages and characteristics derived from the present invention.

The lodging of the clips within the grooves present in the batten and the slat allows the batten to displace the covering in both horizontal directions perpendicular to each other, which allows all the tensions released by the composite, wood or other materials to be absorbed in both dimensional directions.

The invention makes it possible to dismantle and subsequently install any slat at any point in the installation using the same pre-existing components, slats and clips.

The present invention is compatible with a hidden fastening system since it does not require gaps between slats for dismantling.

The present invention allows the clip to be introduced quickly and easily into the slat and clipped into the batten (time-saving since no screws are required).

Since the components of the present invention are not fixed together completely immovably (the components are simply dovetailed together), they absorb the natural expansion movements of the composite, wood or any other material in both dimensional directions.

After dismantling a row of panels or soffit boards the rest of the slats or panels can be slid over the groove in the profiles with no need to be dismantled, and the slat or slats removed can be replaced in the remaining gap at any other point of the surface removed. This system gives access to the installations hidden below the floor or behind the wall or ceiling that covers them, making it easy to repair any damage. Any slat or panel containing lighting components or any other mechanisms can be relocated at any point on the ceiling, wall or floor, by interchanging it for another slat or soffit board where there are no couplings allowing great decorative versatility for the premises.

The components making up the installation can be dismantled, refurbished in a workshop and then re-installed in their locations, thus avoiding the burdensome task of refurbishing them "in situ" and, at the same time, recovering the initial quality because of the ease of refurbishment in a workshop or factory. Also avoided is the environmental attack involved in refurbishment at home, where there are no means for cleansing and filtering waste products.

Although the invention has been described in relation to preferred embodiments, these should not be considered to restrict the invention, which is to be defined by the broadest interpretation of the following claims.

What is claimed is:

1. A covering comprising:

a plurality of panels, each panel comprising, on a lower face of each panel, at least one first guide formed by a first groove giving access to a first cavity with larger dimensions, in cross section, than an opening of the first groove, a plurality of profiles perpendicular to said first grooves on the plurality of panels, said profiles having, a second guide formed by a second groove giving access to a second cavity with larger dimensions, in cross section, than the second groove, and a plurality of clips, each of clips being housed simultaneously in respective cavities at respective intersections of the first guides and the second guides, wherein each clip comprises:

a head to be introduced into the respective cavities of either one of the panels or the profiles, and a resilient body, configured to adopt a first compressed position, in which it passes transversely through respective grooves of the guide in which the head is not housed and to adopt an expanded position, in which the body is housed in the cavity corresponding to the guide in which the head is not housed, wherein said resilient body comprises at least two legs, each leg having a free end and a shoulder area to make contact with a wall of the respective cavities of the corresponding guide immediately adjacent to the corresponding groove such that the shoulder area contacting with the wall is perpendicular to the direction of introduction of the clip to the respective grooves, the free ends of the at least two legs face each other and configured such that one of the free ends is situated above or below the free end of the opposite leg in the first compressed position, and at least one of the clips makes contact with a wall opposite to said wall adjacent to the corresponding groove, such that each clip is compressed resiliently inside the respective cavities of the corresponding guide, in a second compressed position distinct from said first compressed position.

2. The covering according to claim 1, wherein each of the legs comprises the shoulder area that continues into an appendage comprising the free end which points towards a central axis of the clip.

3. The covering according to claim 2, wherein the appendage is curved.

4. The covering according to claim 1, wherein the head of the clip comprises a flat area and protrusions in order to make contact with a wall opposite to the groove of the cavity into which the head is introduced.

5. The covering according to claim 1, wherein the panels have, on at least one of edges of each panel, at least one separating protrusion that does not run along a whole of the at least one of edges and that separates said panel from an adjacent panel.

6. The covering according to claim 5, wherein said at least one separating protrusion is located on an edge parallel to the guides of the panel.

7. The covering according to claim 5, wherein said at least one separating protrusion is located on a single edge of the panel.

8. The covering according to claim 5, wherein the panel has more than one separating protrusion on the at least one edge thereon.

9. The covering according to claim 5, wherein the separating protrusion has a prismatic or cylindrical shape.

10. The covering according to claim 5, wherein the separating protrusion is introduced into a recess formed on the edge of the panel.

11. The covering according to claim 5, wherein the at least one of edges of each panel that comprises the at least one separating protrusion additionally comprises a recess that fits together with a convex portion of an opposite edge of the adjacent panel, or comprises a convex portion that fits together with a recess portion of the opposite edge of the adjacent pane, such that the at least one separating protrusion of the at least one of edges of each panel is not visible from outside.

12. The covering according to claim 11, wherein the at least one of edges of each panel with the at least one separating protrusion has the recess that runs longitudinally along the whole edge, and the at least one separating protrusion have a length equal to or less than a depth of the recess, such that the at least one separating protrusion does not project from the recess.

13. A clip for a covering comprising a plurality of panels and a plurality of profiles, wherein each panel comprises at least one first guide formed by a first groove giving access to a first cavity with larger dimensions, in cross section that an opening of the first groove, and wherein the profiles are perpendicular to said first grooves and comprise a second guide formed by a second groove giving access to a second cavity with larger dimensions in cross section than the second groove, the clip comprising:

a head configured for introduction into the respective cavities of either one of the panels or the profiles, and a resilient body, configured to adopt a first compressed position, in which it passes transversely through respective grooves of the guide in which the head is not housed and to adopt an expanded position, in which the body is housed in the cavity corresponding to the guide in which the head is not housed, said body comprising at least two legs, each leg having a free end and a shoulder area to make contact with a wall of the respective cavities of the corresponding guide immediately adjacent to the corresponding groove, such that the shoulder area contacting with the wall is perpendicular to the direction of introduction of the clip to the respective grooves, wherein the free ends of the at least two legs face each other and configured such that one of the free ends is situated above or below the free end of the opposite leg in the first compressed position, said clip configured to make contact with a wall opposite to a wall adjacent to the corresponding groove, such that the clip is compressed resiliently inside the respective cavities of the corresponding guide, in a second compressed position distinct from the first compressed position.

14. The clip according to claim 13, wherein the shoulder area continues into an appendage, the free end of which points towards a central axis of the clip.

15. The clip according to claim 14, wherein a free appendage is curved.

16. The clip according to claim 13, wherein the head of the clip comprises a flat area and protrusions in order to make contact with a wall opposite the groove in the cavity into which it is introduced.

* * * * *